US005889459A

United States Patent [19]

Hattori et al.

[11] Patent Number: 5,889,459

[45] Date of Patent: Mar. 30, 1999

[54] METAL OXIDE FILM RESISTOR

[75] Inventors: Akiyoshi Hattori, Yawata; Yoshihiro Hori, Hirakata; Masaki Ikeda, Hirakata; Akihiko Yoshida, Hirakata; Yasuhiro Shindo, Katano; Kouzou Igarashi, Takefu, all of Japan

[73] Assignee: Matsushita Electric Industrial Co., Ltd., Japan

[21] Appl. No.: 750,205

[22] PCT Filed: Mar. 28, 1996

[86] PCT No.: PCT/JP96/00809

§ 371 Date: Nov. 27, 1996

§ 102(e) Date: Nov. 27, 1996

[87] PCT Pub. No.: WO96/30915

PCT Pub. Date: Oct. 3, 1996

[30] Foreign Application Priority Data

Mar. 28, 1995 [JP] Japan ..... 7-070132
Mar. 29, 1995 [JP] Japan ..... 7-071516

[51] Int. Cl.[6] ..... H01C 7/06

[52] U.S. Cl. ..... 338/9; 338/7; 338/314; 338/309; 338/254

[58] Field of Search ..... 338/7, 8, 9, 10, 338/225 D, 314, 308, 304, 254

[56] References Cited

U.S. PATENT DOCUMENTS

| | | | |
|---|---|---|---|
| 2,915,730 | 12/1959 | Davis | 338/309 |
| 2,934,736 | 4/1960 | Davis | 338/308 |
| 3,217,281 | 11/1965 | Griest et al. | 338/309 |
| 3,925,261 | 12/1975 | Lauterbach-Dammler | 252/519 |
| 4,258,080 | 3/1981 | Sonoda et al. | 427/82 |
| 4,400,683 | 8/1983 | Eda et al. | 338/21 |
| 4,502,984 | 3/1985 | Kato et al. | 252/518 |
| 4,766,411 | 8/1988 | Prieto et al. | 338/306 |
| 5,089,248 | 2/1992 | Akhtar | 423/604 |
| 5,323,138 | 6/1994 | Oki et al. | 338/307 |
| 5,543,775 | 8/1996 | Huck | 338/306 |

FOREIGN PATENT DOCUMENTS

| | | | |
|---|---|---|---|
| 2-238602 A | 9/1990 | Japan | 338/314 |

*Primary Examiner*—Michael L. Gellner
*Assistant Examiner*—Karl Easthom
*Attorney, Agent, or Firm*—Wenderoth, Lind & Ponack, L.L.P.

[57] ABSTRACT

According to the present invention, there is provided a metal oxide film resistor which has an insulating substrate, a metal oxide resistive film having at least a metal oxide film having a positive temperature coefficient of resistance and/or a metal oxide film having a negative temperature coefficient of resistance, and/or a metal oxide insulating film. The metal oxide film resistor is not affected by moisture or alkali ions in the insulating substrate. The resistance of the film itself does not change. The metal oxide film resistor is extremely reliable.

9 Claims, 6 Drawing Sheets

METAL OXIDE FILM RESISTOR

TECHNICAL FIELD

The invention relates to a metal oxide film resistor having a final resistance of 100 k Ω and more, a small temperature coefficient of resistance (TCR) and a good reliability.

BACKGROUND ART

As shown in FIG. 8, the metal oxide film resistor generally comprises a rod-like insulating substrate 1 of mullite, alumina or the like, a metal oxide film 10 of tin oxide or antimony doped tin oxide (ATO) which is formed on the surface of said substrate, metallic cap terminals 5 and 6 which are pressed in both ends of said substrate, leads 7 and 8 welded to said terminals, and a protective film 9 formed on the surface of the resistor.

By the way, considering materials which can be used as a metal oxide film, the single phase of tin oxide has a too large resistivity and an extremely large negative temperature coefficient of resistance, and therefore, the using conditions are strictly limited and said single phase of tin oxide has no practical use. For such reasons, generally, ATO having a small resistivity and a TCR of positive or nearly 0 is put to practical use as a material of the metal oxide film. In these materials, the carrier density is high. During the rise of the temperature, the scattering effect of the carrier due to the lattice vibrations is larger than the increase of the carrier density due to the excitation energy of heat, and therefore, the TCR is positive and the metallic electric conduction can be obtained. Thus, generally, the material having a small resistivity has a high carrier density and a TCR which is positive or nearly 0. On the other hand, the material having a large resistivity has a low carrier density and a TCR which is negative and large.

The method for producing a metal oxide film resistor as described above generally includes a chemical process for forming a film such as a spraying and a chemical vapor deposition. According to these methods, the vapor of aqueous solution or organic solution containing stannic chloride and antimony trichloride is atomized to the rod-like substrate 1 of mullite-alumina in the furnace in which the temperature is 600° to 800° C., to form ATO film (metal oxide film 10) on the surface of the substrate. Then, the metallic cap terminal 5 and 6 are pressed in both ends of the substrate 1. While the substrate is rotated, a part of ATO film is trimmed with a diamond cutter or a laser to obtain the desired resistance. The leads 7 and 8 are welded to the cap terminals 5 and 6. Thereafter, the protective film 9 of resin is formed to obtain a metal oxide film resistor. The final resistance of the resulting metal oxide film resistor as achieved in such a way is generally 10 Ω to 100 k Ω depending on the thickness of ATO film and the turn number of trimming in the case that the size of the substrate is constant.

According to the conventional method for regulating resistance, in order to obtain a metal oxide film resistor having a final resistance of 100 k Ω and more, the thickness of ATO film may be reduced or the interval of trimming may be narrow.

However, in the case of the conventional construction, the resistivity of ATO film is about $1\times10^{-3}$~$1\times10^{-2}$Ω·cm, and therefore, the thickness of the film must be reduced considerably to raise the resistance value. At this time, because of the distortion of the film itself and the increase of the ratio of the depletion layer in the surface of the film to the whole film, there was a problem that TCR was liable to be negative and large.

Further, because of the low initial resistance of ATO film, in the case of requiring the final resistance of 100 k Ω and more, the turn number of the trimming with a laser must be increased, with the result that the trimming requires extremely much time and the interval of trimming is too narrow. And therefore, there was another problem that the trimming of the film was physically impossible.

As described above, if the thickness of the film is too thin or the interval of the trimming is too narrow, the cross-sectional area of the electric conduction path is reduced and the area in contact with the outside is increased. Because of electrical stress, humidity or the like, the resistance of the film itself changes under the influence of moisture and the alkali ions in the insulating substrate. And therefore, it was difficult to obtain a reliable metal oxide film resistor.

Then, it is an object of the present invention to provide a reliable metal oxide film resistor which is not influenced by moisture or the alkali ions in the insulating substrate and in which the resistance of the film itself does not change.

DISCLOSURE OF THE INVENTION

According to one aspect of the invention, there is provided a metal oxide film resistor which comprises an insulating substrate and a metal oxide resistive film which is formed on said substrate and comprises at least a metal oxide layer having a positive temperature coefficient of resistance and a metal oxide layer having a negative temperature coefficient of resistance.

According to a preferred embodiment, 1) said metal oxide resistive film may comprise a first metal oxide film having a negative temperature coefficient of resistance which is formed on the insulating substrate, and a second metal oxide film having a positive temperature coefficient of resistance which is formed on said layer;
2) said metal oxide resistive film may comprise a second metal oxide layer having a positive temperature coefficient of resistance which is formed on the insulating substrate, and a first metal oxide layer having a negative temperature coefficient of resistance which is formed on said layer; or
3) said metal oxide resistive film may comprise a first metal oxide layer having a negative temperature coefficient of resistance which is formed on said substrate, a second metal oxide film having a positive temperature coefficient of resistance which is formed on said first layer, and a third metal oxide layer having a negative temperature coefficient of resistance which is formed on said layer having a positive temperature coefficient of resistance.

According to a more preferred embodiment, the metal oxide film having a positive temperature coefficient of resistance may contain as a principal component any one of tin oxide, indium oxide or zinc oxide.

According to a second aspect of the invention, there is provided a metal oxide film resistor which comprises an insulating substrate, a metal oxide resistive film comprising at least a metal oxide layer having a positive temperature coefficient of resistance and/or a metal oxide layer having a negative temperature coefficient of resistance, and a metal oxide insulating film.

According to a preferred embodiment, 1) said metal oxide resistive film resistor may comprise a metal oxide insulating film formed on said substrate and a metal oxide resistive film formed on said insulating film;

2) said metal oxide resistive film resistor may comprise a metal oxide resistive film formed on said substrate and a metal oxide insulating film formed on said resistive film; or 3) said metal oxide resistive film resistor may comprise a first metal oxide insulating film formed on said substrate, a metal oxide resistive film formed on said insulating film, and a second metal oxide insulating film formed on said resistive film.

According to a more preferred embodiment, the thickness of the metal oxide insulating film formed on said substrate may be smaller than the surface roughness of said substrate. And said metal oxide resistive film may contain as a principal component at least one selected from the group consisting of tin oxide, indium oxide or zinc oxide, and said metal oxide insulating film may contain as a principal component at least one selected from the group consisting of tin dioxide, zinc oxide, antimony oxide, aluminum oxide, titanium dioxide, zirconium dioxide and silicon dioxide.

DETAILED DESCRIPTION OF THE PREFERRED EMBODIMENTS

Figure 1:
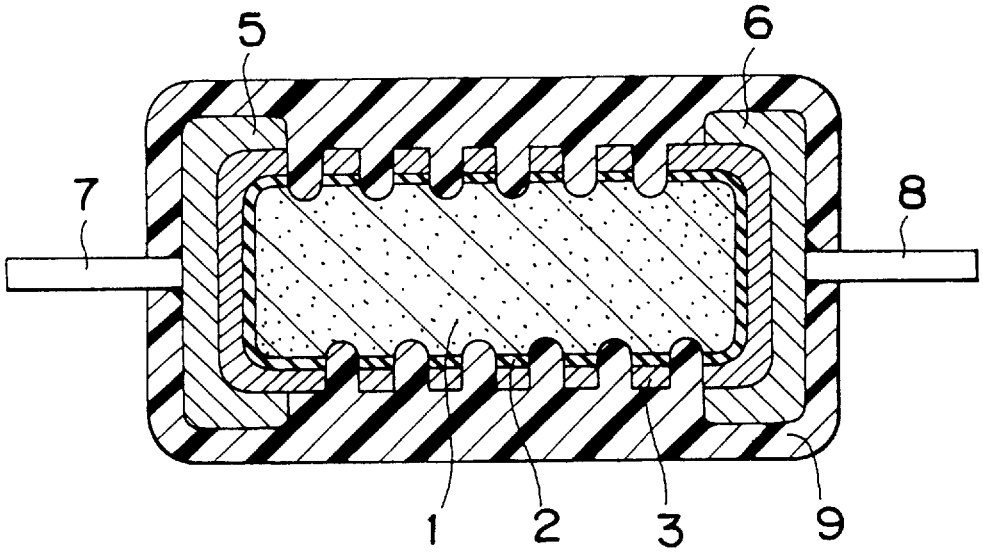
FIG. 1 is a vertical sectional view which illustrates a general construction of a metal oxide film resistor according to an embodiment of the invention.

In this text, the metal oxide film is divided into two, a metal oxide resistive film and a metal oxide insulating film. The metal oxide resistive film means a film which shows a relatively good electric conduction like a metal or a semiconductor. The metal oxide insulating film means a film which has a much poorer electric conduction than said metal oxide resistive film. For example, zinc oxide, tin oxide, titanium oxide or the like may sometimes compose a metal oxide resistive film showing an electric conductance like a semiconductor or may sometimes compose a metal oxide insulating film such as a piezoelectric member, depending on the amount of oxygen deficiency and the added elements (dopant).

The first metal oxide film resistor is characterized by comprising an insulating substrate and a metal oxide resistive film, which is formed on said substrate and comprises at least a metal oxide layer having a positive temperature coefficient of resistance and a metal oxide layer having a negative temperature coefficient of resistance.

According to a first preferred embodiment, the metal oxide film resistor comprises an insulating substrate and a metal oxide layer having a positive temperature coefficient of resistance as a principal resistive member. Further, a metal oxide layer having a negative temperature coefficient of resistance is formed between said substrate and said layer to prevent the diffusion of alkali ions which causes a decline in reliability in the case of a reduced thickness of the high resistance film.

According to a secondary preferred embodiment, the metal oxide film resistor comprises an insulating substrate, a metal oxide layer having a positive temperature coefficient of resistance as a principal resistive member which is formed on said substrate, and further a metal oxide layer having a negative temperature coefficient of temperature which is formed on said layer to prevent some change in quality of said layer having a positive temperature coefficient of resistance due to moisture which causes a decline in reliability in the case of a reduced thickness of the high resistance film.

According to a third preferred embodiment, the metal oxide film resistor comprises an insulating substrate and a metal oxide layer having a positive temperature coefficient of resistance as a principal resistive member. Further, one metal oxide layer having a negative temperature coefficient of resistance is formed between said substrate and said layer, with the other metal oxide layer having a negative temperature coefficient of resistance is formed on said metal oxide layer having a positive temperature coefficient of resistance, so that the first layer acts to prevent diffusion of alkali ions which causes the decline in reliability m and the other layer acts to prevent change in quality of said layer having a positive temperature coefficient of resistance due to moisture.

Said metal oxide layer having a positive temperature coefficient of resistance may contain as a principal component any one of tin oxide, indium oxide or zinc oxide. Addition of an element such as antimony, tin, indium, aluminum, titanium, zirconium and silicon to said metal oxides can make a metal oxide layer to have a positive TCR, a good electric conductance and a high carrier density.

The second metal oxide film resistor according to the present invention is characterized by comprising an insulating substrate, a metal oxide resistive film which comprises at least a metal oxide layer having a positive temperature coefficient of resistance and/or a metal oxide layer having a negative temperature coefficient of resistance, and a metal oxide insulating film.

According to a first preferred embodiment, the metal oxide film resistor comprises an insulating substrate and a metal oxide resistive film which comprises a metal oxide film having a positive temperature coefficient of resistance and/or a metal oxide film having a negative temperature coefficient of resistance as a principal resistive member. The metal oxide insulating film is formed between said substrate and said resistive film to prevent the diffusion of alkali ions which causes the decline in reliability in the case that the thickness of the film is reduced to enhance the resistance.

According to a second preferred embodiment, the metal oxide film resistor comprises an insulating substrate, a metal oxide resistive film which comprises a metal oxide layer having a positive temperature coefficient of resistance and/or a metal oxide layer having a negative temperature coefficient of resistance and which is formed on said substrate, and a metal oxide insulating film formed on said resistive film to prevent the change in quality of said resistive film due to moisture which is the other reason of a decline in reliability in the case that the thickness of the film is reduced to enhance the resistance.

According to a third preferred embodiment, the metal oxide film resistor comprises an insulating substrate and a metal oxide resistive film which comprises a metal oxide layer having a positive temperature coefficient of resistance and/or a metal oxide layer having a negative temperature coefficient of resistance as a resistive member. The metal oxide insulating film is formed between said substrate and said resistive film and on said resistive film to prevent not only the diffusion of alkali ions which causes a decline in reliability in the case that the thickness of the film is reduced to enhance the resistance, but also the change in quality of said resistive film due to moisture.

The thickness of said metal oxide insulating film is smaller than the surface roughness of the substrate, that is, the film is thin, to enable the contact of the metal oxide resistive film with the cap terminal, resulting in elimination of the special means to conduct electricity between both.

Said metal oxide film having a positive temperature coefficient of resistance and/or said metal oxide layer having a negative temperature coefficient of resistance may contain any one of tin oxide, indium oxide or zinc oxide as a principal component. Addition of an element such as antimony, tin, indium, aluminum, titanium, zirconium and silicon to said metal oxides makes a metal oxide resistive film material to have a positive or negative TCR and a relatively high electric conductance.

Said metal oxide insulating film may contain as a principal component at least one selected from the group consisting of tin dioxide, zinc oxide, antimony oxide, aluminum oxide, titanium dioxide, zirconium dioxide and silicon dioxide to prevent not only the diffusion of alkali ions which causes a decline in reliability in the case that the thickness of the film is reduced to enhance the resistance, but also the change in quality of said resistive film due to moisture. Moreover, there is a little mutual diffusion at the contact interface between the metal oxide resistive film containing as a principal component tin oxide, indium oxide, zinc oxide or the like and the metal oxide insulating film, and therefore, said resistive film combines closely with said insulating film electrically, chemically and physically to prevent a decline in reliability due to the enhancement of resistance, with the result that a reliable metal oxide film resistor having a high resistance can be obtained.

EXAMPLES

(Example 1)

Figure 7:
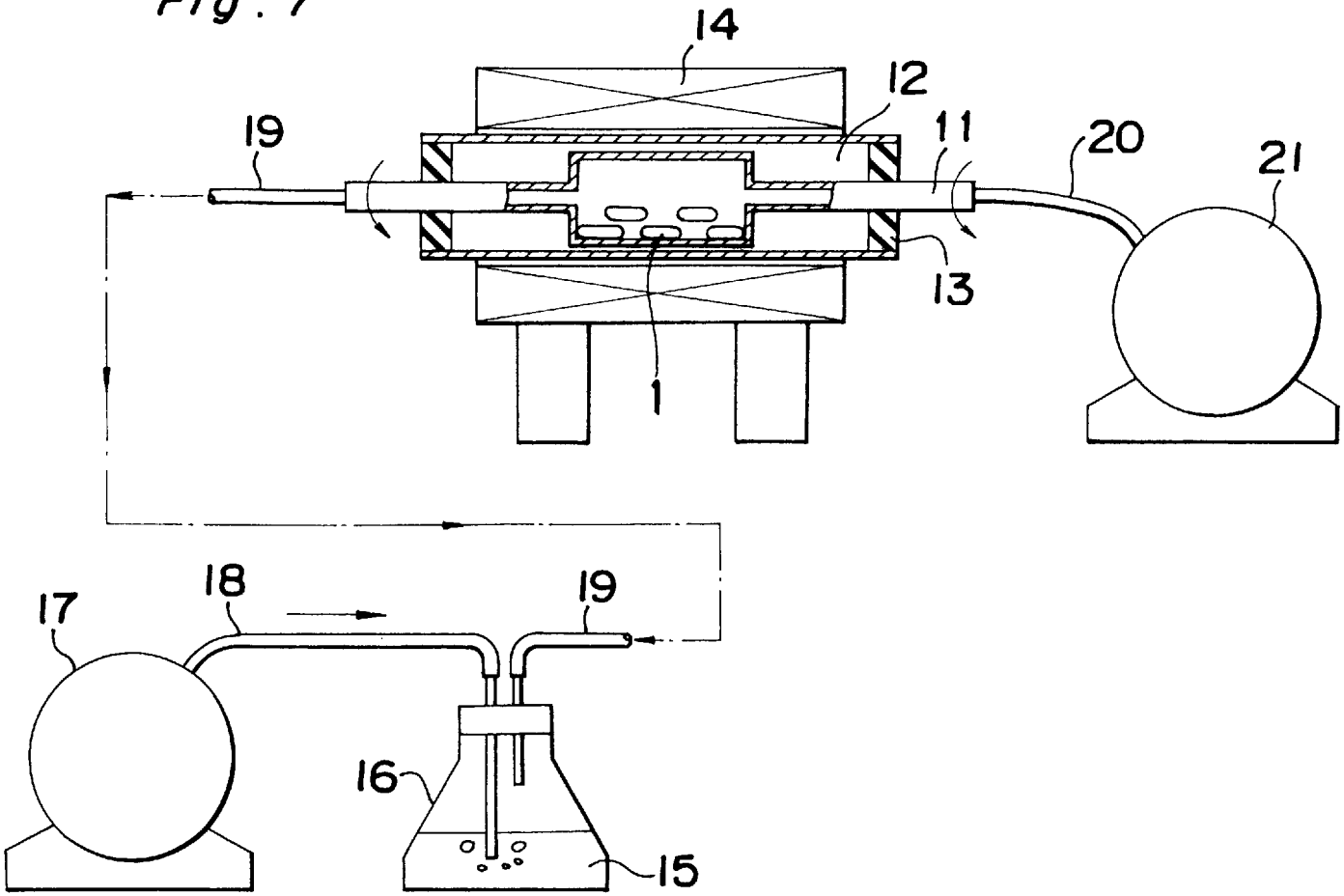
FIG. 7 is a vertical sectional view which illustrates a general construction of a apparatus for forming a metal oxide film according to an embodiment of the invention.
Figure 8:
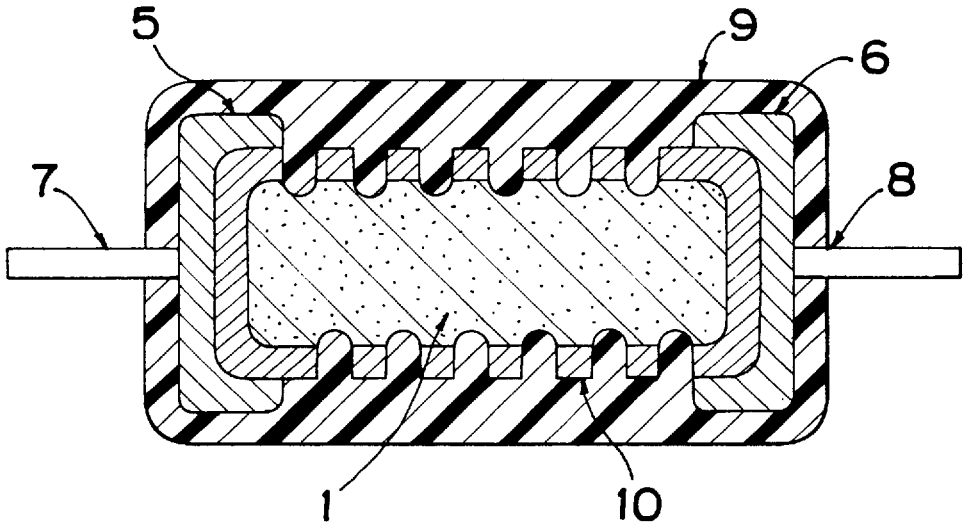
FIG. 8 is a vertical sectional view which illustrates a general construction of a conventional metal oxide film resistor.

FIG. 7 illustrates an apparatus for forming a metal oxide film by supplying the vapor or mist of the composite containing metal oxide to form an insulating film or a resistive film to the heated insulating substrate.

The reacting tube 11 made of quarts in which the substrate on which the metal oxide film is to be formed is put is fixed by the packing 13 in the core tube 12 made of quarts. The core tube 12 which is inserted in the electric furnace 14 is driven by the driving apparatus which is not shown in the figure to rotate at an appropriate rotational speed in the electric furnace 14.

The raw material supplier 16 which accommodates a composite 15 to form a metal oxide film is connected to the gas supplier 17 supplying the carrier gas through the pipe 18 and to the reacting tube 11 through pipe 19. The other end of the reacting tube 11 is connected to the exhauster 21 through the pipe 20.

To form a metal oxide film on the surface of the substrate using this apparatus, first, the substrate is put into the reacting tube 11 and set as shown in FIG. 7. The substrate is heated by the electric furnace 14. While the temperature is kept at the temperature at which said composite to form a metal oxide film decomposes thermally and over, the reacting tube 11 is rotated. In this state, the carrier gas is fed from the gas supplier 17 into the raw material supplier 16 through the pipe 18, and the vapor or the mist of the composite to form a metal oxide film is supplied to the reacting tube 11 through the pipe 19. Said vapor or mist supplied to the reacting tube 11 comes in contact with the substrate and decomposes to form a metal oxide film on the surface of the substrate. The undecomposed composite to form a metal oxide is sucked, cooled and collected by the gas exhauster 21. Air, oxygen, nitrogen or an inert gas such as argon is used as a carrier gas which is supplied from the gas supplier 17.

The flow rate of the carrier gas can control the amount of supply of said vapor or mist. The amount of supply of said vapor or mist can be also controlled by heating the raw material supplier 16 or by applying ultrasonic waves to the raw material supplier 16.

The reason for rotating the reacting tube 11 is to form a metal oxide film uniformly on the substrate. The mechanical vibrations can be applied to the reacting tube 11 instead of rotating it. It is not particularly necessary to rotate the core tube 12. In the example, the core tube 12 is fixed to stabilize rotation of the reacting tube 11.

FIG. 1 is a metal oxide film resistor according to an example of the invention. The construction of the example will be described in connection with this figure.

As shown in this figure, the metal oxide film resistor of the present invention comprises an insulating substrate 1, a metal oxide film 2 having a negative TCR which is formed on said substrate 1, a metal oxide film 3 having a positive TCR which is formed on said film 2, metallic cap terminals 5 and 6 which are pressed in both ends of said substrate, leads 7 and 8 which are welded to said terminals, and a protective film 9 which is formed on the surface of the resistor.

The same reference number designates the identical element in FIGS. 1 to 6 and FIG. 8.

At least the surface of the substrate may be insulated. The substrate is preferably made of porcelain such as mullite, alumina, cordierite, forsterite and steatite. And said film 2 is to prevent alkali ions from diffusing into said film 3. Said film 2 has a lower electric conductance than said film and may be made of the material to form a metal oxide film having a negative TCR. Said film preferably contains as a principal component tin oxide, indium oxide or zinc oxide. Moreover, said film 3 may be made of the material to form a metal oxide film having a positive TCR, a high electric conductance and a high carrier density. Said film preferably contains as a principal component tin oxide, indium oxide or zinc oxide. The element such as antimony, tin, indium, aluminum, titanium, zirconium and silicon is doped to these metal oxides to obtain a metal oxide resistive film material having a positive TCR, a high electric resistance and a high carrier density. Antimony, phosphorus, arsenic or the like may be doped to tin oxide. Tin, titanium, zirconium, silicon, cerium or the like may be doped to indium oxide. Aluminum, indium or the like may be doped to zinc oxide.

The composite to form a metal oxide film 2 having a negative TCR and the composite to form a metal oxide film 3 having a positive TCR were synthesized in a way as described below.

In a 200 ml conical flask, 5 g of stannic chloride ($SnCl_4 \cdot 5H_2O$) and 10 mol% (an equation of M/(Sn+M) )of silicon tetraethoxide ($Si(OCH_2CH_3)_4$) were weighed and dissolved in 75 ml of methanol to synthesize a composite to form said film (2). And in a 200 ml conical flask, 5 g of stannic chloride ($SnCl_4 \cdot 5H_2O$) and 3 mol% (an equation of MI(Sn+M) ) of antimony trichloride ($SbCl_3$) were weighed and dissolved in 68 ml of methanol and 8 ml of concentrated hydrochloric acid to synthesize a composite to form said film (3).

The cylindrical substrate 1 of 92% alumina (outer diameter: 2 mm Φ×10 mmL, Ra:0.3 μm) was put into the reacting tube and the composite to form said film (2) was poured into the raw material supplier 16, using said apparatus for forming a film as shown in FIG. 7. Air was used as a carrier gas, the gas flow rate was 1 liter/min, and the heating temperature of the substrate 1 was 800° C. The heating temperature of the substrate 1 may be the deforming temperature of the substrate or the melting point of said film 2 or below them. The higher the heating temperature is, the better the quality of said film obtained is. The heating temperature is preferably 400° to 900° C.

The substrate 1 in the reacting tube 11 was kept at 800° C. for 30 minutes and 3 g of said composite to form a film (2) was fed into the reacting tube 11 for 20 minutes to form said film 2. Thereafter, the resulting film was kept at 800° C. for 10 minutes as it was. The thickness of said film 2 formed in such a way was generally several tens to several thousands nm, however, in this example, the thickness of said film 2 was about 250 nm.

In the same way, the substrate 1 on which said film 2 was formed was put into the reacting tube and the composite to form said film (3) was poured into the raw material supplier 16, using said apparatus for forming a film. Air was used as a carrier gas, the gas flow rate was 1 liter/min, and the heating temperature of the substrate 1 was 800° C. The heating temperature of the substrate 1 may be the deforming temperature of the substrate 1 or the melting point of said films 2 and 3 or below them. The higher the heating temperature was, the better the quality of said film 3 obtained was. The heating temperature was preferably 400° to 900° C.

The substrate 1 in the reacting tube 11 was kept at 800° C. for 30 minutes and 1 g of said composite to form said film (3) was fed into the reacting tube 11 for 5 minutes to form said film 3. Thereafter, the resulting film was kept at 800° C. for 10 minutes as it was. The thickness of said film 3 formed in such a way was generally several tens to several thousands nm, however, in this example, the thickness of said film 3 was about 150 nm.

The tin-plated stainless steel cap terminals 5 and 6 were pressed in both ends of the substrate 1 on which said films 2 and 3 were formed. The resulting substrate was trimmed with 8 turns by means of a diamond cutter and thereafter, the tin-plated copper leads 7 and 8 were welded to said cap terminals 7 and 8. The cap terminals 5 and 6 may be any one which is connected to said resistive film 3 ohmically and the leads 7 and 8 may also be any one which is connected to said cap terminals 5 and 6 ohmically.

At last, the paste of thermosetting resin is applied to the surface of said film 3, dried, and heated at 150° C. for 10 minutes to form an insulating film 9, resulting in a metal oxide film resistor of the present invention. The resistive film 9 may be any one which is insulating and resistive to moisture. Resin alone or resin containing an inorganic filler may be used as a material to form a protective film. Rays such as visible rays and ultraviolet rays may be used for curing instead of heat.

(Example 2)

Figure 2:
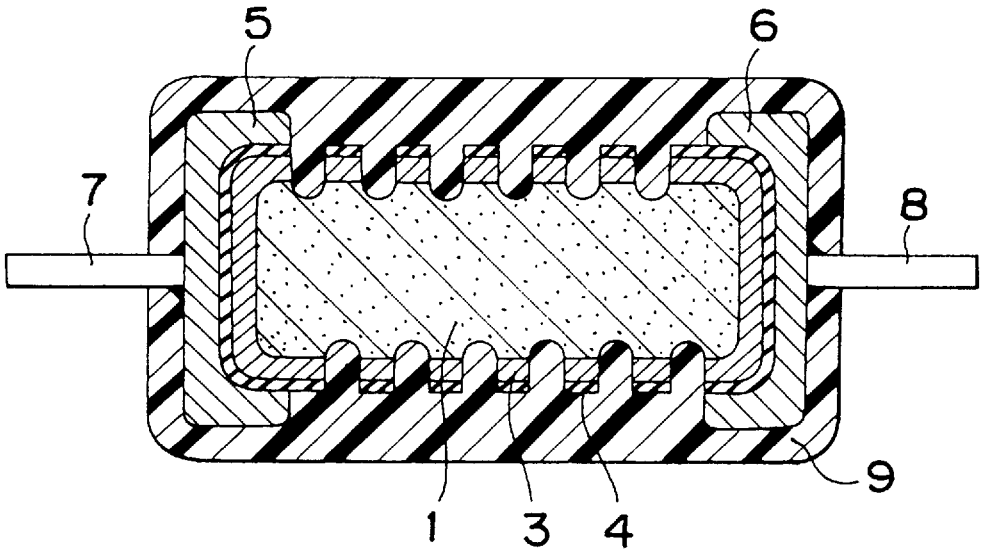
FIG. 2 is a vertical sectional view which illustrates a general construction of metal oxide film resistor according to another embodiment of the invention.

FIG. 2 illustrates a metal oxide film resistor according to an example of the invention. The construction of the example will be described in connection with this figure.

As shown in this figure, the metal oxide film resistor of the present invention comprises an insulating substrate 1, a metal oxide film 3 having a positive TCR which is formed on said substrate 1, a metal oxide film 4 having a negative TCR which is formed on said film 3, metallic cap terminals 5 and 6 which are pressed in both ends of said substrate, leads 7 and 8 which are welded to said terminals, and a protective film 9 which is formed on the surface of the resistor.

Said film 4 is to prevent the change in quality of said film 3 due to moisture and has a lower electric conductance than said film 3. Said film may be made of any material to form a film having a negative TCR and preferably contain as a principal component tin oxide, indium oxide or zinc oxide.

In a 200 ml conical flask, 5 g of stannic chloride ($SnCl_4 \cdot 5H_2O$), 9 mol% (an equation of M/(Sn+M) ) of antimony trichloride ($SbCl_3$) and 10 mol% (an equation of M/(Sn+M) ) of ferric chloride ($FeCl_3$) were weighed and dissolved in 68 ml of methanol and 8 ml of concentrated hydrochloric acid to synthesize a composite to form said film (4).

The composite to form said film (3) was fed into the reacting tube 11 for 10 minutes so as to form said resistive film 3 using said apparatus for forming a film. The thickness of said resistive film 3 of the present invention was about 300 nm.

In the same way, the substrate 1 on which said resistive film 3 was formed was put into the reacting tube and the composite to form said film (4) was poured into the raw material supplier 16, using said apparatus for forming a film. Air was used as a carrier gas, the gas flow rate was 1 liter/min, and the heating temperature of the substrate 1 was 800° C. The heating temperature of the substrate 1 may be the deforming temperature of the substrate 1 or the melting point of said films 3 and 4 or below them. The higher the heating temperature was, the better the quality of said film 3 obtained was. The heating temperature was preferably 400° to 900° C.

The substrate 1 in the reacting tube 11 was kept at 800° C. for 30 minutes and 1 g of said composite to form said film (4) was fed into the reacting tube 11 for 15 minutes to form said film 4. Thereafter, the resulting film was kept at 800° C. for 10 minutes as it was. The thickness of said film 4 formed in such a way was generally several tens to several thousands nm, however, in this example, the thickness of said film 4 was about 100 nm. The same process as that of Example 1 except the process described above was repeated.

(Example 3)

Figure 3:
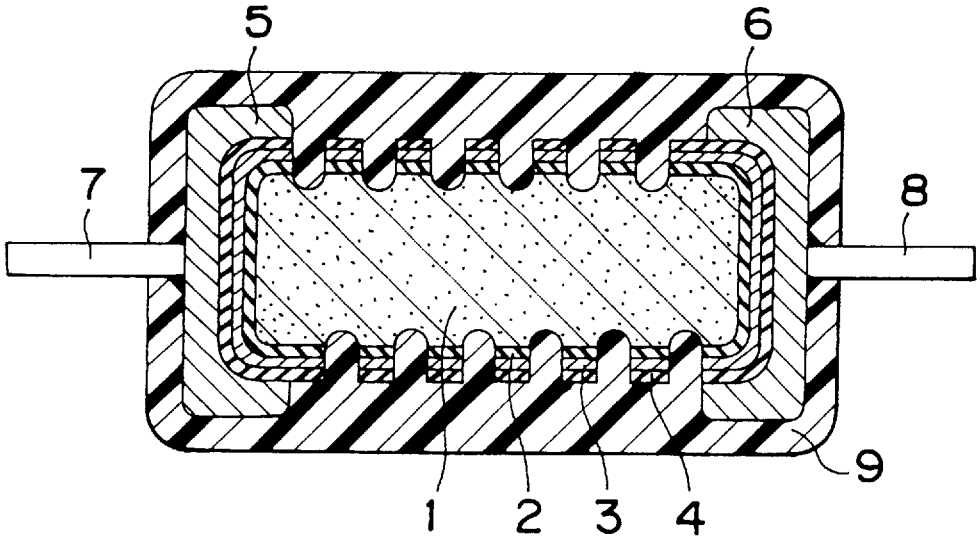
FIG. 3 is a vertical sectional view which illustrates a general construction of a metal oxide film resistor according to still another embodiment of the invention.

FIG. 3 illustrates a metal oxide film resistor according to an example of the invention. The construction of the example will be described in connection with this figure.

As shown in this figure, the metal oxide film resistor of the present invention comprises an insulating substrate 1, a metal oxide film 2 having a negative TCR which is formed on said substrate 1, a metal oxide film 3 having a positive TCR which is formed on said film 2, a metal oxide film 4 having a negative TCR which is formed on said film 3, metallic cap terminals 5 and 6 which are pressed in both ends of said substrate, leads 7 and 8 which are welded to said terminals, and a protective film 9 which is formed on the surface of the resistor.

In a 200 ml conical flask, 5 g of stannic chloride ($SnCl_4 \cdot 5H_2O$), 9 mol% (an equation of M/(Sn+M) ) of antimony trichloride ($SbCl_3$) and 10 mol% (an equation of M/(Sn+M)) of chromium trichloride ($CrCl_3 \cdot 6H_2O$) were weighed and dissolved in 68 ml of methanol and 8 ml of concentrated hydrochloric acid to synthesize a composite to form said film (4).

The substrate 1 on which said film 2 and 3 were formed was put into the reacting tube 11 and 1.8 g of the composite to form said film (4) was fed into the reacting tube 11 for 10 minutes, using said apparatus for forming a film, so as to form said film 4. Thereafter, the resulting film was kept at 800° C. for 10 minutes as it was. The thickness of said film 4 of the present example was about 100 nm. The same process as that of Example 1 except the process described above was repeated.

(Comparative Example 1)

To compare with other examples, in Example 2 as described above, the resistor of Comparative Example 1 having a metal oxide film 3 alone of two kinds of metal oxide films was made without the metal oxide film 4 formed. The rest construction was the same as that of Example 2.

(Comparative Example 2)

To compare with other examples, the resistor of Comparative Example 2 was made.

To be concrete, 0.5 g of the composite to form a metal oxide film was fed into the reacting tube 11 for 3 minutes. The thickness of said film of the example was about 80 nm. The rest construction was the same as that of Comparative Example 1.

Table 1 shows the results of Examples 1 to 3 and the results of Comparative Example 1 and 2. The rate of change is the rate of change in resistance at the time when the humidity test was conducted at 60° C. and 95% RH for 100 hours.

TABLE 1

| | initial resistance (Ω) | final resistance (k Ω) | TCR (ppm/°C.) | rate of change (%) |
|---|---|---|---|---|
| Example 1 | 260 | 520 | −120 | −0.23 |
| Example 2 | 320 | 640 | −47 | −0.31 |
| Example 3 | 480 | 960 | −180 | −0.14 |
| Com. Ex. 1 | 34 | 68 | 140 | −0.26 |
| Com. Ex. 2 | 650 | 1300 | −900 | −5.63 |

As shown in Table 1, the resistor of Comparative Example 1 has a final resistance of 100 k Ω and less, and on the basis of such a fact, the performance of the resistor of Comparative Example 1 may be identical to that of the conventional resistor. In Comparative Example 2, the thickness of the film was about one-fourth of that of Comparative Example 1 and the final resistance was certainly high. However, the results of the rate of change indicates that the performance of the resistor of Comparative Example 2 is liable to change with age and is not reliable.

On the contrary, any one of the resistors of Examples 1 to 3 has a final resistance of 100 k Ω and more, a small TCR and a good reliability. Especially, the resistor of Example 3 has the highest resistance and a good reliability.

In the examples as described above, the different kinds of metal oxide films were formed two-fold or three-fold. However, it is to be understood that the invention is not intended to be limited to the specific examples. The construction in which only one film comprising a part having a positive temperature coefficient of resistance and the other part having a negative temperature coefficient of resistance is formed on the surface of the substrate may be used. And said construction may be combined with the above-mentioned multi-fold films.

(Example 4)

Figure 4:
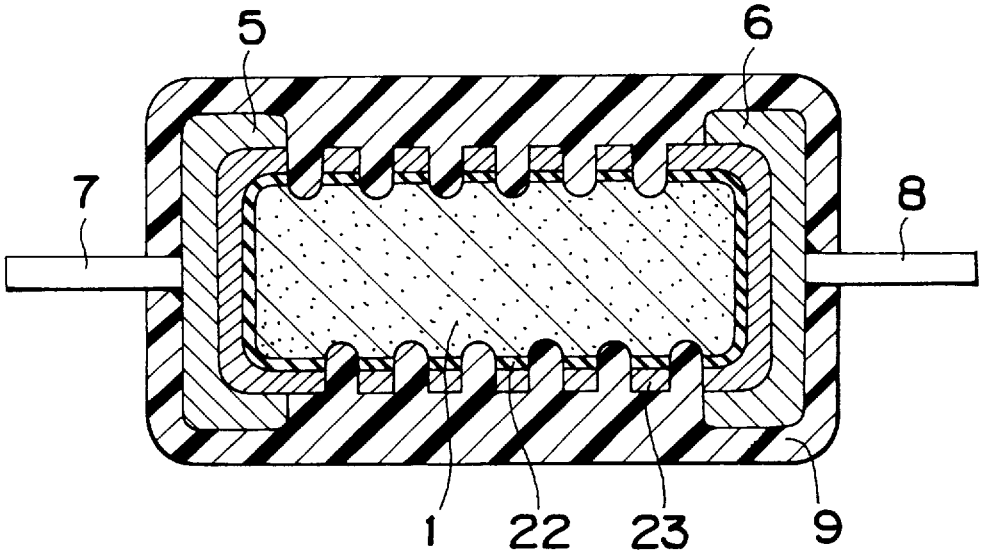
FIG. 4 is a vertical sectional view which illustrates a general construction of a metal oxide film resistor according to still another embodiment the invention.

FIG. 4 illustrates a metal oxide film resistor according to an example of the invention. The construction of the example will be described in connection with this figure.

As shown in this figure, the metal oxide film resistor of the present invention comprises an insulating substrate 1, a metal oxide insulating film 22 which is formed on said substrate 1, a metal oxide resistive film 23 which is formed on said insulating film 22, metallic cap terminals 5 and 6 which are pressed in both ends of said substrate, leads 7 and 8 which are welded to said terminals, and a protective film 9 which is formed on the surface of the resistor.

At least the surface of the substrate maybe insulated. The substrate is preferably made of porcelain such as mullite, alumina, cordierite, forsterite and steatite. And said insulating film 22 is to prevent alkali ions from diffusing into said resistive film 23. Said insulating film 22 preferably contains as a principal component tin dioxide, zinc oxide, antimony oxide, aluminum oxide, titanium dioxide, zirconium dioxide or silicon dioxide. Moreover, said resistive film 23 may be made of the material having a high electric conductance and a high carrier density. Said film preferably contains as a principal component tin oxide, indium oxide or zinc oxide. The element such as antimony, tin, indium, aluminum, titanium, zirconium and silicon is doped to these metal oxides to obtain a metal oxide resistive film material having a positive TCR, a high electric resistance and a high carrier density. Antimony, phosphorus, arsenic or the like may be doped to tin oxide. Tin, titanium, zirconium, silicon, cerium or the like may be doped to indium oxide. Aluminum, indium or the like may be doped to zinc oxide.

The cap terminals 5 and 6 may be any one which is connected to said resistive film 3 ohmically and the leads 7 and 8 may also be any one which is connected to said cap terminals 5 and 6 ohmically.

First, the composite to form a metal oxide insulating film 22 and the composite to form a metal oxide resistive film 23 were synthesized in a way as described below.

In a 200 ml conical flask, 10 ml of silicon tetraethoxide ($Si(OCH_2CH_3)_4$) were weighed and dissolved in 40 ml of methanol to synthesize a composite to form said insulating film. And in a 200 ml conical flask, 5 g of stannic chloride ($SnCl_4 \cdot 5H_2O$) and 0.09 (in mole of metal M, obtained from an equation of M/(Sn+M) ) of antimony trichloride ($SbCl_3$) were weighed and dissolved in 68 ml of methanol and 8 ml of concentrated hydrochloric acid to synthesize a composite to form said resistive film.

Next, using the apparatus as shown in FIG. 7, the metal oxide insulating film and the metal oxide resistive film was formed sequentially on the surface of the cylindrical substrate 1 containing 92% of alumina (outer diameter: 2 mm, length: 10 mm, surface roughness Ra:0.3 μm) in a way as described below.

Said substrate 1 was put into the reacting tube 11 and the composite to form an insulating film was poured into the raw material supplier 16. Air was used as a carrier gas, the gas flow rate was 1 liter/min, and the heating temperature of the substrate 1 was 800° C. The heating temperature of the substrate 1 may be the deforming temperature of the substrate or the melting point of an insulating film to be formed or below them. The higher the heating temperature is, the better the quality of said insulating film obtained is. The heating temperature is preferably 600° to 900° C.

The substrate 1 in the reacting tube 11 was kept at 800° C. for 30 minutes and 7 g of the composite to form an insulating film was fed into the reacting tube 11 for 30 minutes to form an insulating film 22 on the surface of the substrate. Thereafter, the resulting film was kept at 800° C. for 10 minutes as it was. The thickness of said insulating film 22 formed in such a way was generally several tens to several thousands nm, however, in this example, the thickness of said film 2 was about 300 nm. Then, in the same way, the substrate 1 on which the insulating film 22 was formed was put into the reacting tube 11 and the composite to form an resistive film was poured into the raw material supplier 16. Air was used as a carrier gas, the gas flow rate was 1 liter/min, and the heating temperature of the substrate 1 was 800° C. The heating temperature of the substrate 1 may be the deforming temperature of the substrate or the melting point of the insulating film 22 and a resistive film 23 to be formed or below them. The higher the heating temperature is, the better the quality of said insulating film obtained is. The heating temperature is preferably 400° to 900° C.

The substrate 1 in the reacting tube 11 was kept at 800° C. for 30 minutes and 1.2 g of the composite to form a resistive film was fed into the reacting tube 11 for 7 minutes to form a resistive film 23. Thereafter, the resulting film was kept at 800° C. for 10 minutes as it was. The thickness of said resistive film 3 formed in such a way was generally several tens to several thousands nm, however, in this example, the thickness of said film 3 was about 200 nm.

The tin-plated stainless steel cap terminals 5 and 6 were pressed in both ends of the substrate 1 on which said insulating films 22 and said resistive film 23 were formed. The resulting substrate was trimmed with 8 turns by means of a diamond cutter and thereafter, the tin-plated copper leads 7 and 8 were welded to said cap terminals 7 and 8.

At last, the paste of thermosetting resin was applied to the surface of said resistive film 23, dried, and heated at 150° C. for 10 minutes to form an insulating protective film 9, resulting in a metal oxide film resistor of the present invention. The protective film 9 may be any one which is insulating and resistive to moisture. Resin alone or resin containing an inorganic filler may be used as a material to form a protective film. Rays such as visible rays and ultraviolet rays instead of heat may be used for hardening the protective film.

(Example 5)

Figure 5:
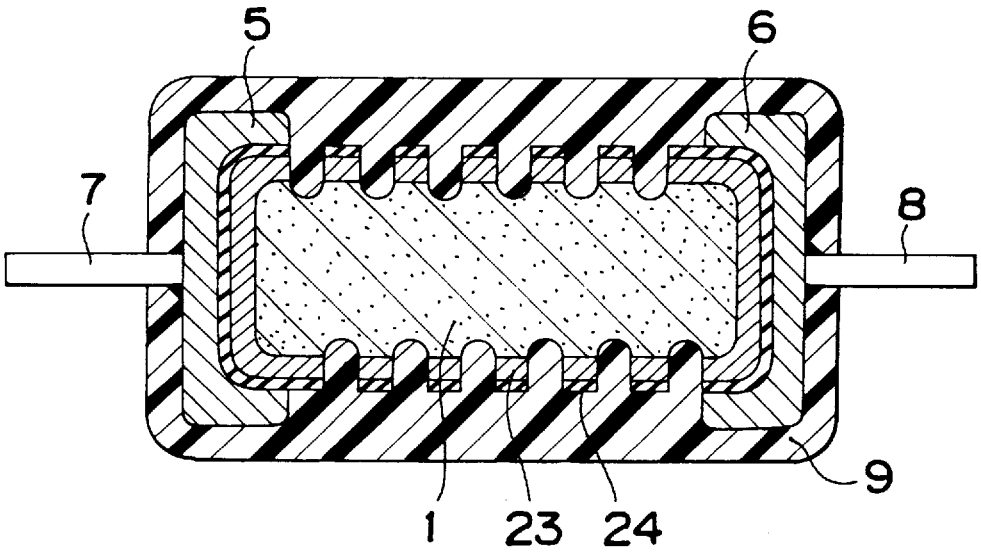
FIG. 5 is a vertical sectional view which illustrates a general construction of a metal oxide film resistor according to still another embodiment of the invention.

FIG. 5 illustrates a metal oxide film resistor according to an example of the invention. The construction of the example will be described in connection with this figure.

As shown in this figure, the metal oxide film resistor of the example is different from the one as shown in FIG. 4, since the metal oxide film resistor of the example comprises a metal oxide resistive film 23 formed on the insulating substrate 1 and a metal oxide insulating film 24 formed on said resistive film. Said insulating film 24 is to prevent the change in quality of the resistive film 23 due to moisture or the like and made of the same material as the insulating film as shown in FIG. 4.

In a 200 ml conical flask, 2 g of aluminum chloride ($AlCl_3$) was weighed and dissolved in 75 ml of methanol to synthesize a composite to form a metal oxide insulating film.

In the same way as Example 4, using an apparatus as shown in FIG. 7, the substrate in the reacting tube 11 was kept at 800° C. for 30 minutes and then, 2.5 g of the composite to form a resistive film, which is the same as that of Example 1, in the raw material supplier 16 was fed into the reacting tube 11 for 15 minutes to form a resistive film 23 on the surface of the substrate. Air was used as a carrier gas, the gas flow rate was 1 liter/min. Thereafter, the resulting film was kept at 800° C. for 10 minutes as it was. The thickness of said resistive film formed in such a way was about 400 nm.

Next, the substrate 1 on which the resistive film 23 was formed was put in the reacting tube 11 and kept at 800° C. for 30 minutes. Then, 1 g of said composite to form an insulating film in the raw material supplier 16 was fed into the reacting tube 11 for 5 minutes to form an insulating film 24 on the surface of the resistive film 23. Air was used as a carrier gas, the gas flow rate was 1 liter/min. Thereafter, the resulting film was kept at 800° C. for 10 minutes as it was. The thickness of said insulating film 24 formed in such a way was about 50 nm.

(Example 6)

Figure 6:
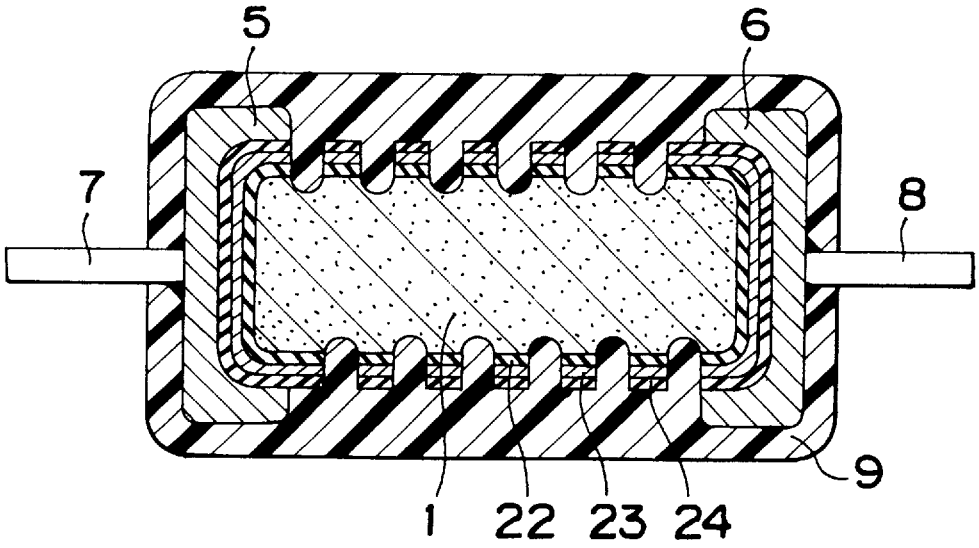
FIG. 6 is a vertical sectional view which illustrates a general construction of a metal oxide film resistor according to still another embodiment of the invention.

FIG. 6 illustrates a metal oxide film resistor according to an example of the invention. The construction of the example will be described in connection with this figure.

As shown in this figure, the metal oxide film resistor of the example is different from the one as described above, since the metal oxide insulating film 22, the metal oxide resistive film 23 and the metal oxide insulating film 24 were formed sequentially on the insulating substrate 1.

The sizes of parts as shown in FIGS. 4 to 6 are not always correct. Particularly, FIGS. 5 and 6 show that the caps 5 and 6 are not in contact with the resistive film 23. However, considering the fact that the surface of the substrate 1 is rough and the film 24 formed on said substrate is thin and so on, the cap terminals pressed in on the film 24 remove a part of the film 24 and come in contact with the resistive film 23 electrically.

In a 200 ml conical flask, 10 ml of titanium tetraisopropoxide ($Ti(OCH(CH_3)CH_3)_4$) was weighed and dissolved in 40 ml of methanol to synthesize a composite to form a metal oxide insulating film.

In the same way as Example 4, using an apparatus as shown in FIG. 7, the substrate on which the insulating film 22 and the resistive film 23 were formed sequentially was put in the reacting tube 11 was kept at 800° C. for 30 minutes. Then, 4 g of said composite to form an insulating film in the raw material supplier 16 was fed into the reacting tube 11 for 20 minutes to form a resistive film 23 on the surface of the insulating film 24. Air was used as a carrier gas, the gas flow rate was 1 liter/min. Thereafter, the resulting film was kept at 800° C. for 10 minutes as it was. The thickness of said insulating film 24 formed in such a way was about 100 nm.

(Comparative Example 3)

The resistor was made in the same way as Example 5 except that the metal oxide insulating film 24 was not formed.

(Comparative Example 4)

The resistor was made in the same way as Comparative Example 3 except that 1 g of the composite to form a metal oxide film was fed into the reacting tube for 5 minutes to obtain a resistive film 23 having a thickness of about 100 nm.

Table 2 shows the comparative results of the properties of the resistors according to Examples 4 to 6 and Comparative Example 3 and 4. Each final resistance is about 200 times that before the trimming. The rate of change is the rate of change of the resistance after the resistor was kept at 60° C. and 95% RH for 100 hours to the resistance before that. The temperature coefficient of resistance (TCR) is obtained at 25° to 125° C.

TABLE 2

| | final resistance (k Ω) | TCR (ppm/°C.) | rate of change (%) |
|---|---|---|---|
| Example 4 | 640 | −400 | −0.12 |
| Example 5 | 400 | −500 | −0.18 |
| Example 6 | 820 | −450 | −0.09 |
| Com. Ex. 3 | 72 | 130 | −0.06 |
| Com. Ex. 4 | 1360 | −1000 | −5.22 |

As shown in Table 2, the resistor of Comparative Example 3 has a final resistance of 100 k Ω and less, and on the basis of such a fact, the performance of the resistor of Comparative Example 3 may be identical to that of the conventional resistor. In Comparative Example 4, the thickness of the film is about one-fourth of that of Comparative Example 3 and the final resistance is certainly high. However, the results of the rate of change indicate that the performance of the resistor of Comparative Example 4 is liable to change with age and is not reliable.

On the contrary, any one of the resistors of Examples 4 to 6 has a final resistance of 100 k Ω and more, a small TCR and a good reliability. Especially, the resistor of Example 6 has the highest resistance and a good reliability.

In the examples as described above, the different kinds of metal oxide resistive film and metal oxide insulating film were formed two-fold or three-fold. However, it is to be understood that the invention is not intended to be limited to the specific examples. The construction in which only one metal oxide insulating film comprising a part composed of a metal oxide resistive film and the other part composed of a metal oxide insulating film is formed on the surface of the substrate may be used. And said construction may be combined with the above-mentioned multi-fold films.

In the examples as described above, the metal oxide resistive film and the metal oxide insulating film were formed using CVD method. The physical method such as sputtering and vacuum evaporation and the chemical method such as spraying and dipping may be used in combination with one another.

POSSIBILITY OF INDUSTRIAL UTILIZATION

As described above, according to the present invention, there is provided a metal oxide film resistor having a resistance of wide range and a small TCR, which is applicable to the resistor for public welfare and for the circuit of industrial devices.

We claim:

1. A metal oxide film resistor comprising an insulating substrate and a metal oxide resistive film formed on said substrate, wherein said insulating substrate has a surface roughness over 0.3 μm, and said metal oxide resistive film comprises at least a first metal oxide layer having a negative temperature coefficient of resistance and a second metal oxide layer having a positive temperature coefficient of resistance, said first metal oxide consisting essentially of a tin oxide and at least one metal oxide in an amount under 10 mol% selected from the group consisting of ferric oxide, chromium oxide and silicon oxide.

2. The metal oxide film resistor according to claim 1 wherein said metal oxide resistive film comprises the first metal oxide layer having a negative temperature coefficient of resistance formed on said substrate and the second metal oxide layer having a positive temperature coefficient of resistance formed on said first metal oxide layer.

3. The metal oxide film resistor according to claim 1 wherein said metal oxide resistive film comprises the second metal oxide layer having a positive temperature coefficient of resistance formed on said substrate and the first metal oxide layer having a negative temperature coefficient of resistance formed on said second metal oxide layer.

4. The metal oxide film resistor according to claim 1 wherein said metal oxide resistive film comprises the first metal oxide layer having a negative temperature coefficient of resistance formed on said substrate, the second metal oxide resistive layer having a positive temperature coefficient of resistance formed on said first metal oxide layer, and a third metal oxide layer having a negative temperature coefficient of resistance formed on said second metal oxide layer.

5. The metal oxide film resistor according to claim 1 wherein said metal oxide layer having a positive temperature coefficient of resistance contains at least one selected from the group consisting of tin oxide, indium oxide and zinc oxide as a principal component.

6. A metal oxide film resistor according to claim 1 wherein a metal oxide insulating film is formed at a location selected from the group consisting of on, under and both on and under said metal oxide resistive film.

7. A metal oxide film resistor according to claim 6 wherein said metal oxide insulating film contains as a principal component at least one selected from the group consisting of tin dioxide, zinc oxide, antimony oxide, aluminum oxide, titanium dioxide, zirconium dioxide and silicon dioxide.

8. The metal oxide film resistor according to claim 6 wherein the elements which are the principal elements of said metal oxide resistive film, said metal oxide insulating film and said insulating substrate diffuse mutually at the contact interfaces between said resistive film, said insulating film and said substrate.

9. A metal oxide film resistor according to claim 6 wherein the metal oxide insulating film is formed on said substrate and the thickness of said metal oxide insulating film is smaller than the surface roughness of said substrate to enable contact between the metal oxide resistive film and a cap terminal.

* * * * *